US007911431B2

(12) United States Patent
Jung

(10) Patent No.: US 7,911,431 B2
(45) Date of Patent: Mar. 22, 2011

(54) LIQUID CRYSTAL DISPLAY DEVICE AND METHOD OF DRIVING THE SAME

(75) Inventor: Han-Yung Jung, Daegu (KR)

(73) Assignee: LG Display Co., Ltd., Seoul (KR)

( * ) Notice: Subject to any disclaimer, the term of this patent is extended or adjusted under 35 U.S.C. 154(b) by 469 days.

(21) Appl. No.: 11/968,066

(22) Filed: Dec. 31, 2007

(65) Prior Publication Data

US 2008/0180380 A1 Jul. 31, 2008

(30) Foreign Application Priority Data

Jan. 29, 2007 (KR) ..... 10-2007-0008752

(51) Int. Cl.
*G09G 3/36* (2006.01)

(52) U.S. Cl. ..... 345/89; 345/96; 345/209; 345/690; 345/204

(58) Field of Classification Search ..... 345/87–103, 345/204, 208–210, 690–691
See application file for complete search history.

(56) References Cited

U.S. PATENT DOCUMENTS 5,677,704 A * 10/1997 Kusano et al. ..... 345/89
6,353,435 B2 * 3/2002 Kudo et al. ..... 345/204
6,825,824 B2 * 11/2004 Lee ..... 345/89
2001/0038372 A1 * 11/2001 Lee ..... 345/89
2002/0196218 A1 * 12/2002 Ham ..... 345/87
2003/0184508 A1 * 10/2003 Lee ..... 345/87
2004/0179002 A1 * 9/2004 Park et al. ..... 345/204
2004/0263495 A1 * 12/2004 Sugino et al. ..... 345/204
2005/0001802 A1 * 1/2005 Lee ..... 345/89
2005/0162369 A1 * 7/2005 Kim et al. ..... 345/98
2005/0195144 A1 * 9/2005 Kwon et al. ..... 345/89
2006/0109220 A1 * 5/2006 Ham ..... 345/87
2006/0267893 A1 * 11/2006 Kim et al. ..... 345/89
2010/0134533 A1 * 6/2010 Moon et al. ..... 345/690

OTHER PUBLICATIONS

Lee, Seung-Woo et al., "Late-News Paper: a Novel Dithering Algorithm for High Color Depth and High Color Performance: Hi-FRC," SID 04 Digest, 2004, 1482-1485.
Adv-FRC, Engineering Report, LG Philips LCD May 16, 2005 1-11.

* cited by examiner

*Primary Examiner* — Lun-Yi Lao
(74) *Attorney, Agent, or Firm* — Brinks Hofer Gilson & Lione

(57) ABSTRACT

A liquid crystal display device includes first to third FRC portions. The first to third FRC portions converts n-bit R, G and B input data into (n−m)-bit R, G and B data having first to third FRC patterns for consecutive P frames according to lower m bits of the n-bit R, G and B input data, respectively. The (n−m)-bit R, G and B data for each of the consecutive P frames correspond to R, G and B sub-pixels of the pixels of the pixel block, respectively.

10 Claims, 4 Drawing Sheets

LIQUID CRYSTAL DISPLAY DEVICE AND METHOD OF DRIVING THE SAME

CLAIM FOR PRIORITY

This application claims the benefit of priority from Korean Patent Application No. 2007-0008752, filed on Jan. 29, 2007, the entire content of which is incorporated by reference.

BACKGROUND

1. Technical Field

The present invention relates to a liquid crystal display device and a method of driving the same.

2. Related Art

Some display devices use cathode-ray tubes (CRTs). Other display devices may be flat panel displays, such as liquid crystal display (LCD) devices, plasma display panels (PDPs), field emission displays (FED), and electro-luminescence displays (ELDs). Some of these flat panel displays may be driven by an active matrix driving method in which a plurality of pixels arranged in a matrix configuration are driven using a plurality of thin film transistors. Among these active matrix type flat panel displays, liquid crystal display (LCD) devices and electroluminescent display (ELD) devices may have a higher resolution, and increased ability to display colors and moving images as compared to some of the other flat panel display devices.

An LCD device may include two substrates that are spaced apart and face each other with a layer of liquid crystal molecules interposed between the two substrates. The two substrates may include electrodes that face each other. A voltage applied between the electrodes may induce an electric field across the layer of liquid crystal molecules. The alignment of the liquid crystal molecules may be changed based on an intensity of the induced electric field, thereby changing the light transmissivity of the LCD device. Thus, the LCD device may display images by varying the intensity of the electric field across the layer of liquid crystal molecules.

FIG. 1 is a block diagram illustrating an LCD device according to the related art, and FIG. 2 is a circuit diagram illustrating a liquid crystal panel of FIG. 1.

Referring to FIG. 1, the LCD device includes a liquid crystal panel 2 and a driving circuit 26. The driving circuit 26 may include gate and data drivers 20 and 18, a timing controller 12, a gamma reference voltage generator 16, a power supply 14 and an interface 10.

Referring to FIG. 2, the liquid crystal panel 2 includes a plurality of gate lines GL1 to GLn along a first direction and a plurality of data lines DL1 to DLm along a second direction.

The plurality of gate lines GL1 to GLn and the plurality of data lines DL1 to DLm cross each other to define a plurality of sub-pixels. Each sub-pixel includes a thin film transistor TFT and a liquid crystal capacitor LC. The liquid crystal capacitor LC includes a pixel electrode connected to the thin film transistor TFT, a common electrode, and a liquid crystal layer between the pixel and common electrodes. Red (R), green (G) and blue (B) sub-pixels forms one pixel.

Referring to FIG. 1, the interface 10 is supplied with red (R), green (G) and blue (B) data and control signals such as a vertical synchronization signal, a horizontal synchronization signal, a data enable signal, and a data clock signal. The RGB data and control signals are supplied from an external system, such as a computer system.

The timing controller 12 is supplied with the control signals from the interface 10 and generates control signals to control the gate and data drivers 20 and 18. The timing controller 12 processes the RGB data and supplies the processed data to the data driver 18. The gate driver 20 is supplied with the control signals from the timing controller 12 to sequentially output gate voltages to the gate lines GL1 to GLn. The gate lines GL1 to GLn are sequentially selected, and the thin film transistors TFT connected to the selected gate line GL1 to GLn are turned on. The data driver 18 is supplied with the RGB data and the control signals from the timing controller 12. The data driver 18 outputs data voltages to the data lines DL1 to DLm when the gate line GL1 to GLn is selected.

The gamma reference voltage generator 16 generates gamma reference voltages which are supplied to the data driver 18. The gamma reference voltages are used to generate the RGB data voltages corresponding to the RGB data. The R, G and B data voltages are inputted to the corresponding R, G and B sub-pixels.

The power supply 14 supplies voltages that operate the components of the LCD device.

Even though not shown in the drawings, the LCD device includes a backlight unit to supply light for the liquid crystal panel 2.

The LCD device is usually supplied with 8-bit RGB data from the external system. Accordingly, the driving circuit, for example, the data driver needs driving ICs capable of processing the 8-bit data. However, the driving ICs cost high.

To reduce the cost, the LCD device uses driving ICs processing the RGB data having a bit number less than eight. To use the driving ICs, a data-processing method to convert the 8-bit data into the data having the lower bit number is required. To do this, a frame rate control (FRC) method is suggested. The timing controller 12 performs the FRC operation.

In detail, the timing controller 12 reconstructs frame data such that the LCD device including the driving ICs which process (n−m)-bit data displays images using (n−m) bits among n bits of an n-bit RGB input data.

The m indicates a bit number of lower bits of the input data. The timing controller 12 converts the n-bit input data into an (n−m)-bit data such that among consecutive $2^m$ frames, a number of frames where the converted data has a gray level A represented by the upper (n−m) bits of the input data and a number of frames where the converted data has a next higher gray level (A+1) are adjusted according to the lower m bits of the input data.

Furthermore, the timing controller 12 converts the n-bit input data into a predetermined number of (n−m)-bit data, respectively, assigned to a predetermined number of pixels in a pixel block such that a total number of pixels displaying the gray level A and the total number of pixels displaying the gray level (A+1) for each of $2^m$ frames are adjusted according to the lower m bits of the input data.

Because human eyes recognize spatio-temporal average of the gray level of the (n−m)-bit data, the image appears the same as that displayed by the n-bit data. Accordingly, $2^m$ gray levels between the gray levels A and (A+1) can be additionally displayed.

FIG. 3 is a block diagram illustrating a timing controller of an LCD device according to the related art.

Referring to FIG. 3, a timing controller 12 includes an FRC portion 13 to perform an FRC operation. The FRC portion 13 converts R, G and B input data into R', G' and B' data. For example, the input data is 9-bit data and the converted data is 6-bit data. The external system usually supplies 8-bit RGB data to the LCD device. The timing controller 12 expands the 8-bit RGB data into a 9-bit RGB data through a process such as adding a lowermost bit having a value of 0 to the 8-bit RGB data. The expanded 9-bit data is inputted to the FRC conversion 13 as the input data.

According to values of lower 3 bits of the 9-bit input data, upper 6 bits of the 9-bit RGB input data are processed to generate the 6-bit RGB data. For example, the FRC conversion 13 converts the 9-bit RGB input data into the 6-bit RGB data, respectively, assigned to pixels, each of which has R, G and B sub-pixels, of a pixel block using a look-up table (LUT) according to the lower 3 bits of the 9-bit input data. In other words, the 9-bit input data is converted into the 6-bit data, respectively, assigned to the pixels of the pixel block for $2^m$ frames according to the lower 3 bits.

Accordingly, an FRC pattern of the converted data generated by the FRC portion 13 depends on the lower 3 bits of the input data.

FIG. 4 is a view illustrating FRC patterns of R, G and B data generated through an FRC portion of an LCD device according to the related art. In FIG. 4, a pixel block includes eight pixels in a 2×4 (two rows by four columns) matrix. Each pixel includes R, G and B sub-pixels. For convenience of explanation, the R, G and B sub-pixels of pixels in a matrix form are separately described in FIG. 4. In other words, a top portion of FIG. 4 describes the R sub-pixels of the pixels, a center portion of FIG. 4 describes the G sub-pixels of the pixels, and a bottom portion of FIG. 4 describes the B sub-pixels of the pixels. Further, for convenience of explanation, FIG. 4 describes the FRC patterns for former four frames $S^{th}$ to $(S+3)^{th}$ frames among consecutive eight frames.

Referring to FIG. 4, converted 6-bit R, G and B data (R', G' and B' of FIG. 3) through the FRC portion (13 of FIG. 3) are written to the corresponding R, G and B sub-pixels during $S^{th}$ to $(S+3)^{th}$ frames. In other words, data voltages corresponding to the converted R, G and B data are applied to the corresponding R, G and B sub-pixels. The R, G and B sub-pixels each alternately have a positive or negative polarity per frame according to an inversion operation. Hatched sub-pixels each have a gray level A represented by upper 6 bits of an 9-bit input data, and non-hatched sub-pixel each have a next higher gray level (A+1) to the gray level A represented by the upper 6 bits of the 9-bit input data.

Because the R, G and B data are commonly converted through the related art FRC portion, the converted R, G and B data have the same FRC pattern. For example, in each pixel block, arrangement of the hatched R, G and B sub-pixels and the non-hatched R, G and B sub-pixels are the same for each frame. Accordingly, a case may occur where the higher gray level R, G and B data are concentrated on some specific pixels of the pixel blocks. This causes pattern such as flowing line pattern 30 and lattice pattern 40 in some regions as described in FIG. 5 or flicker, and thus display quality is degraded.

SUMMARY

A liquid crystal display device includes a liquid crystal panel including a pixel block including pixels, the pixel including R, G and B sub-pixels; a first FRC portion converting an n-bit R input data into (n−m)-bit R data having a first FRC pattern for consecutive P frames according to lower m bits of the n-bit R input data. The (n−m)-bit R data for each of the consecutive frames correspond to the R sub-pixels of the pixels of the pixel block, respectively. A second FRC portion converts an n-bit G input data into (n−m)-bit G data having a second FRC pattern for the consecutive P frames according to lower m bits of the n-bit G input data. The (n−m)-bit G data for each of the consecutive P frames correspond to the G sub-pixels of the pixels of the pixel block, respectively. A third FRC portion converts an n-bit B input data into (n−m)-bit B data having a third FRC pattern for the consecutive P frames according to lower m bits of the n-bit B input data, wherein the (n−m)-bit B data for each of the consecutive P frames correspond to the B sub-pixels of the pixels of the pixel block, respectively, wherein the first to third FRC pattern are different, and wherein the n and m are natural number and the n is over the m.

In another aspect of the present invention, a method of driving a liquid crystal display device includes converting an n-bit R input data into (n−m)-bit R data having a first FRC pattern for consecutive P frames according to lower m bits of the n-bit R input data; converting an n-bit G input data into (n−m)-bit G data having a second FRC pattern for the consecutive P frames according to lower m bits of the n-bit G input data; converting an n-bit B input data into (n−m)-bit B data having a third FRC pattern for the consecutive P frames according to lower m bits of the n-bit B input data; and displaying images through a liquid crystal panel including a pixel block including pixels, the pixel including R, G and B sub-pixels, wherein the (n−m)-bit R data for each of the consecutive P frames correspond to the R sub-pixels of the pixels of the pixel block, respectively, wherein the (n−m)-bit G data for each of the consecutive P frames correspond to the G sub-pixels of the pixels of the pixel block, respectively, wherein the (n−m)-bit B data for each of the consecutive P frames correspond to the B sub-pixels of the pixels of the pixel block, respectively, wherein the first to third FRC pattern are different, and wherein the n and m are natural number and the n is over the m.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION

Reference will now be made in detail to an embodiment of the present invention, examples of which is illustrated in the accompanying drawings.

Figure 6:
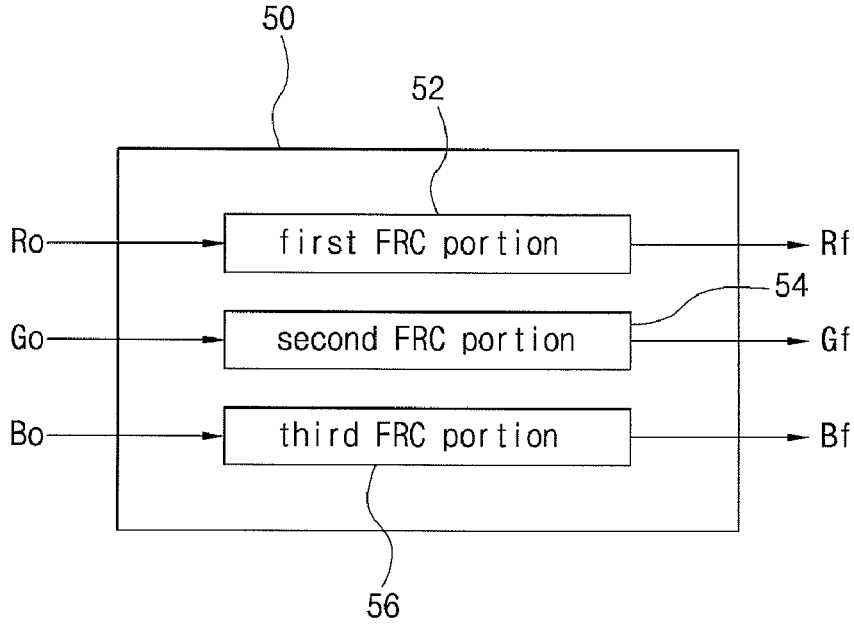
FIG. 6 is a block diagram illustrating a timing controller of an LCD device according to an embodiment.
Figure 7:
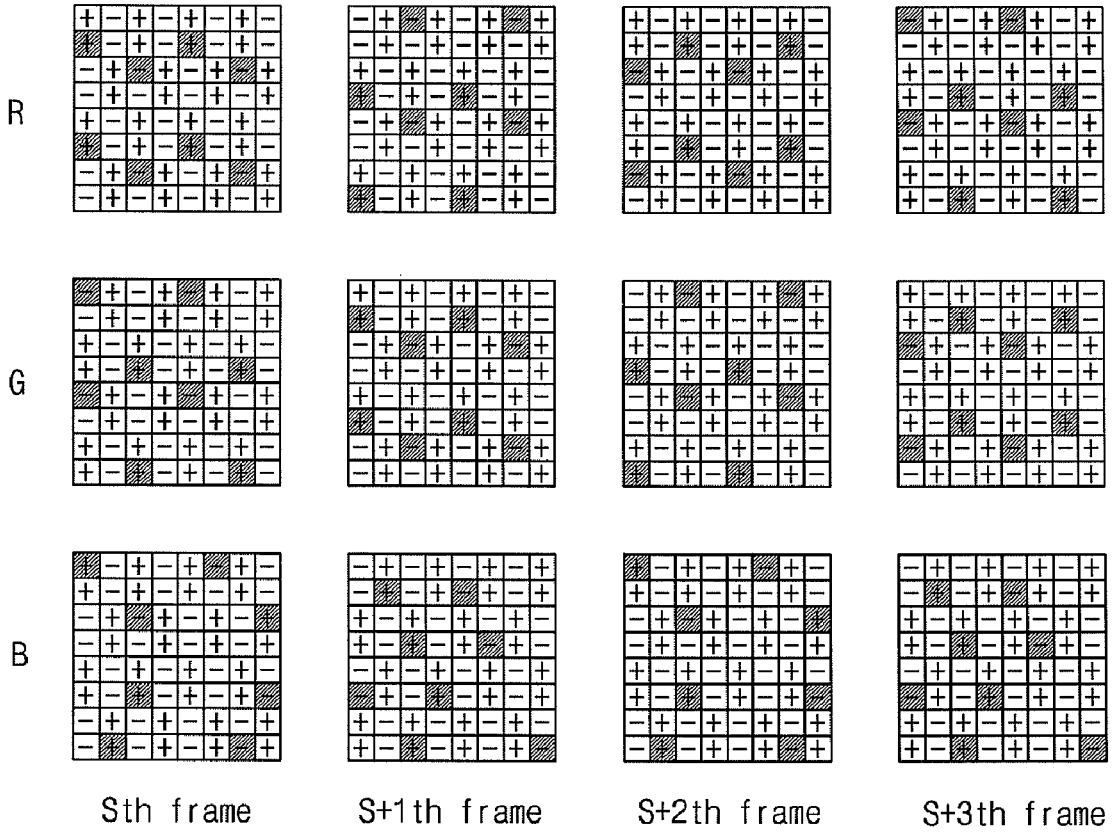
FIG. 7 is a view illustrating FRC patterns of R, G and B data generated through first to third FRC portions, respectively, of FIG. 6.

FIG. 6 is a block diagram illustrating a timing controller of an LCD device according to an embodiment, and FIG. 7 is a view illustrating FRC patterns of R, G and B data generated through first to third FRC portions, respectively, of FIG. 6. The LCD device according to the embodiment may be similar to the related art LCD device except for the FRC portion. Accordingly, explanations of parts similar to parts of the related art may be omitted.

Figure 1:
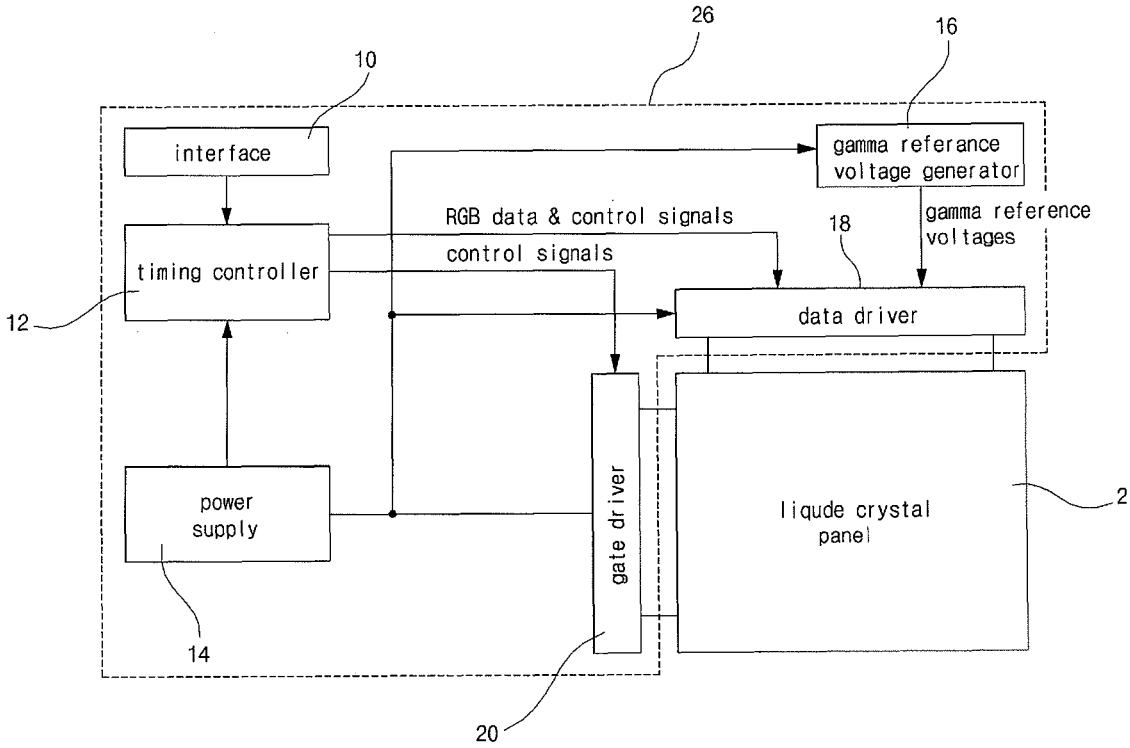
FIG. 1 RELATED ART
FIG. 1 is a block diagram illustrating an LCD device according to the related art.
Figure 2:
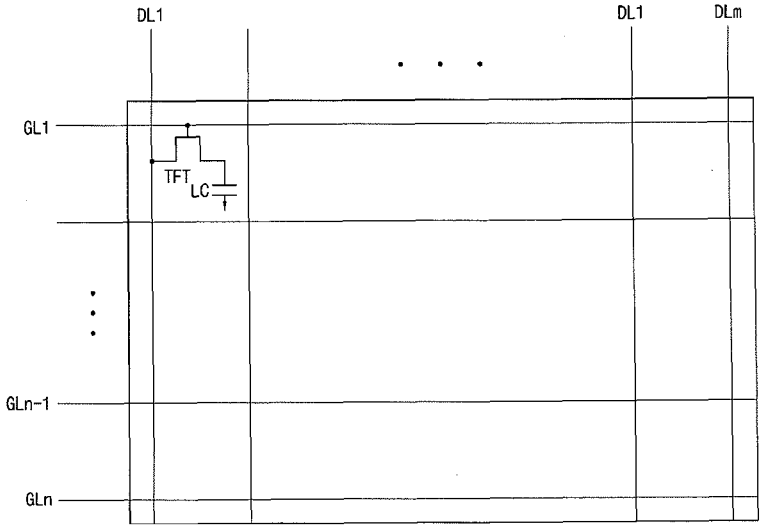
FIG. 2 RELATED ART
FIG. 2 is a circuit diagram illustrating a liquid crystal panel of FIG. 1.
Figure 3:
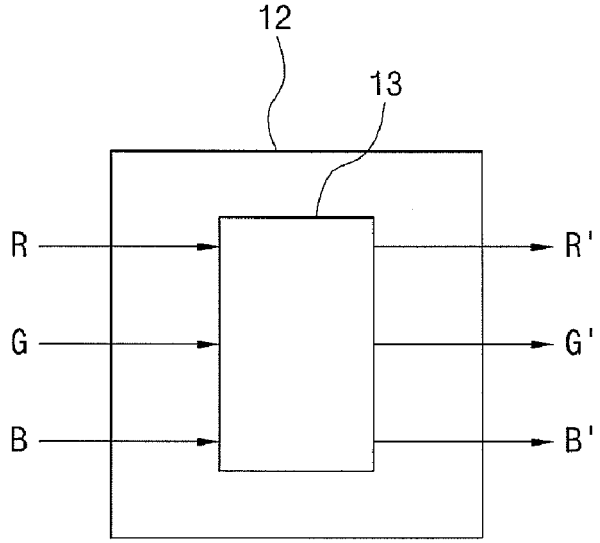
FIG. 3 RELATED ART
FIG. 3 is a block diagram illustrating a timing controller of an LCD device according to the related art.
Figure 4:
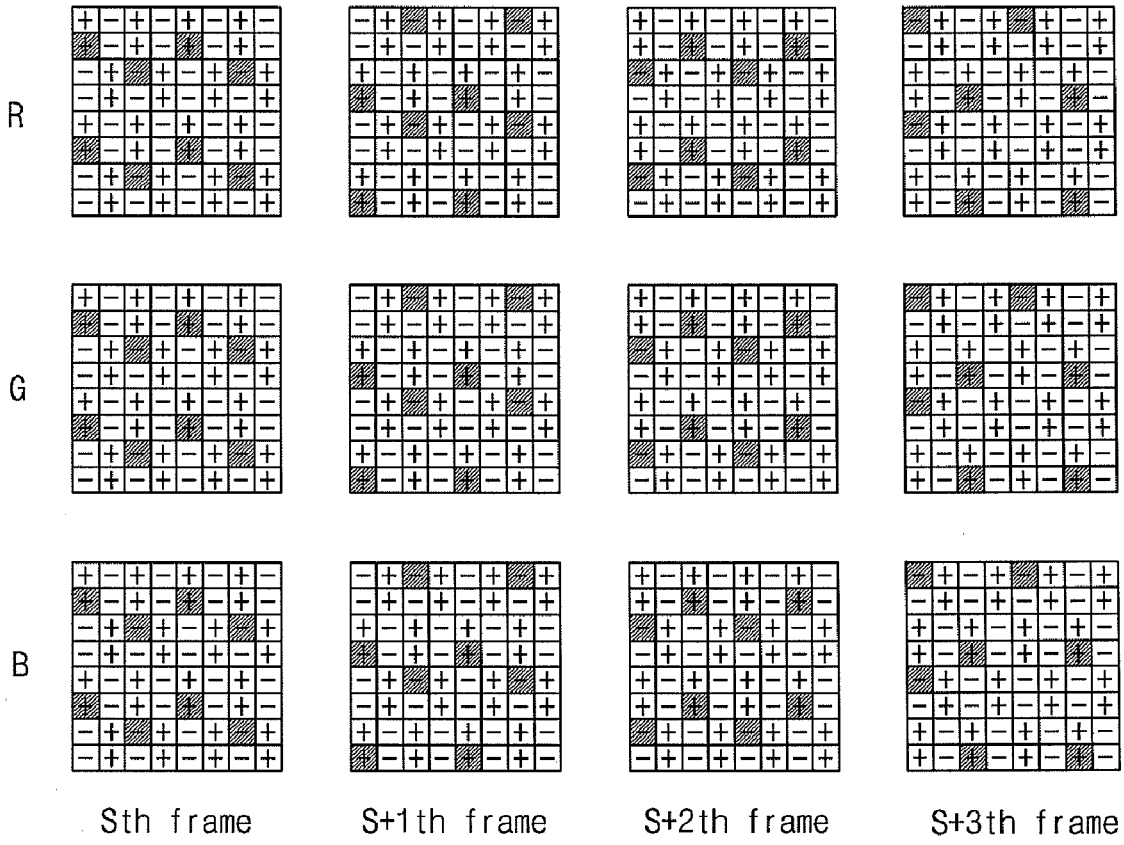
FIG. 4 RELATED ART
FIG. 4 is a view illustrating FRC patterns of R, G and B data generated through an FRC portion of an LCD device according to the related art.
Figure 5:
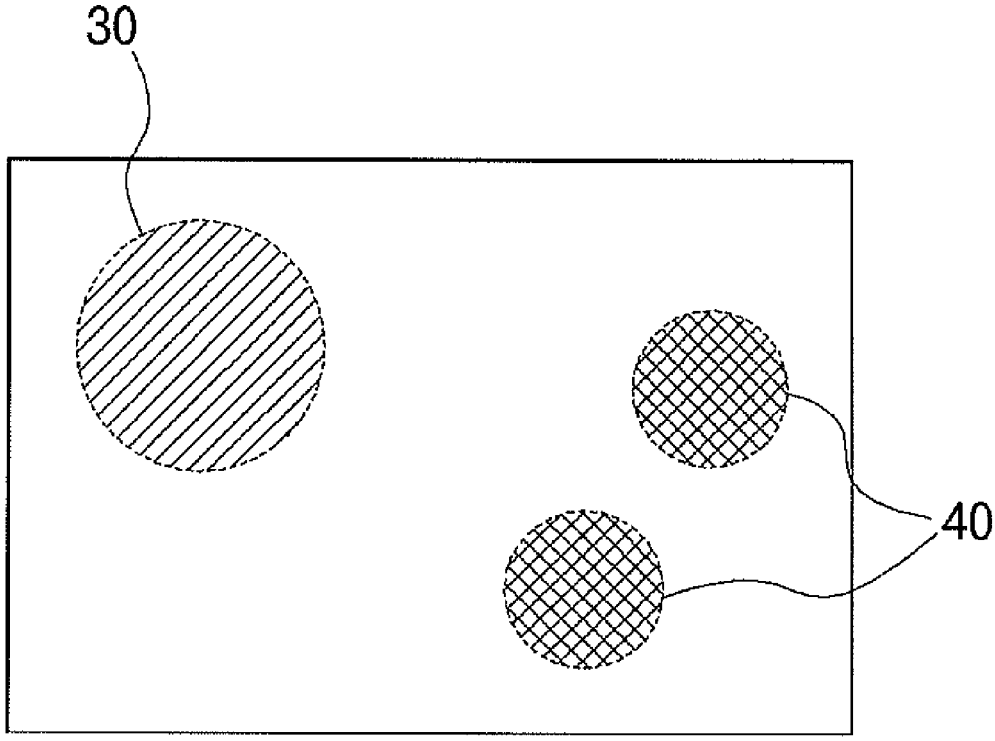
FIG. 5 RELATED ART
FIG. 5 is a view illustrating flowing line pattern 30 and lattice pattern 40 occurring in an LCD device according to the related art.

Referring to FIG. 6, the LCD device includes a timing controller 50 including first to third FRC portions 52, 54 and 56. The LCD device may further include a liquid crystal panel, gate and data drivers, an interface, a power supply and a gamma reference voltage generator, as described in FIGS. 1 and 2.

The first to third FRC portions 52, 54 and 56 may be supplied with n-bit R, G and B input data Ro, Go and Bo, respectively. The first to third FRC portions 52, 54 and 56 may perform FRC operations independently from one another. Accordingly, converted R, G and B data Rf, Gf and Bf may have FRC patterns independent from one another.

An external system may supply r-bit R, G and B source data to the LCD device. The r-bit R, G and B source data may be converted into the n-bit R, G and B data Ro, Go and Bo, and this conversion may be performed in the timing controller 50. For example, this conversion may be performed in a manner to add a lowermost bit having a value of 0 to the r-bit data. Such the converted n-bit R, G and B data may be used as the R, G and B input data Ro, Go and Bo.

The first FRC portion 52 converts the n-bit R input data Ro into (n−m)-bit R data Rf, respectively, assigned to R sub-pixels of a pixel block according to lower m bits of the n-bit R input data. The pixel block includes pixels, for example, pixels in a K×L matrix, and the pixel includes red, green and blue sub-pixels. The K and L may be a natural number more than 1. The converted R data Rf are written to the corresponding R sub-pixels of the pixel block per frame for P frames. The P may be $2^m$. Assuming that the n is 9, the m is 3, the K is 2, the L is 4 and the P is $2^3$ (=8). The first FRC portion 52 converts a 9-bit R input data Ro to generate eight 6-bit R data Rf written to the corresponding eight R sub-pixels for each frame. A first FRC operation for one R input data Ro may be performed to generate converted R data Rf for eight frames. Accordingly, a total number of the converted R data generated from one R input data may be 64 to write the converted R data into the corresponding R sub-pixels for eight frames.

The FRC pattern of the converted R data Rf for eight frames generated by the first FRC operation may be determined according to values of lower 3 bits of the 9-bit R input data, and a first LUT may be used to perform the first FRC operation according to the lower 3 bits of the 9-bit R input data. The values of lower 3-bits are (000), (001), (010), (011), (100), (101), (110) and (111). The first FRC portion 52 performs the first FRC operation to generate different FRC patterns according to the values of the lower 3 bits.

In other words, in each frame, a number of the R sub-pixels of the pixel block having a gray level A represented by the upper 6 bits of the 9-bit R input data and a number of the R sub-pixels of the pixel block having a next higher gray level (A+1) may be determined according to the values of the lower 3 bits of the 9-bit R input data. Further, positions of the R sub-pixels of the pixel block having the gray level A and positions of the R sub-pixels of the pixel block having the next higher gray level (A+1) may be determined according to the values of the lower 3 bits of the 9-bit R input data. Accordingly, the R sub-pixels of the pixel block have the FRC pattern through the first FRC operation.

The second FRC portion 54 may convert the 9-bit G input data Go into 6-bit G data Gf, respectively, assigned to the G sub-pixels of the pixel block according to lower 3 bits of the 9-bit G input data. The eight 6-bit G data Gf generated through the second FRC portion 54 are written to the corresponding eight G sub-pixels for each frame. A second FRC operation for one G input data is performed to generate converted G data for eight frames. Accordingly, a total number of the converted G data generated from one G input data may be 64 to write the converted G data into the corresponding G sub-pixels for eight frames.

The FRC pattern of the converted G data Gf for eight frames generated by the second FRC operation may be determined according to values of lower 3 bits of the 9-bit G input data, and a second LUT may be used to perform the second FRC operation according to the values of lower 3 bits of the 9-bit G input data. The values of lower 3-bits are (000), (001), (010), (011), (100), (101), (110) and (111). The second FRC portion 54 performs the second FRC operation to generate different FRC patterns according to the values of the lower 3 bits.

In other words, in each frame, a number of the G sub-pixels of the pixel block having a gray level A represented by the upper 6 bits of the 9-bit G input data and a number of the G sub-pixels of the pixel block having a next higher gray level (A+1) may be determined according to the values of the lower 3 bits of the 9-bit G input data. Further, positions of the G sub-pixels of the pixel block having the gray level A and positions of the G sub-pixels of the pixel block having the next higher gray level (A+1) may be determined according to the values of the lower 3 bits of the 9-bit G input data. Accordingly, the G sub-pixels of the pixel block have the FRC pattern through the second FRC operation.

The third FRC portion 56 may convert the 9-bit B input data Bo into 6-bit B data Bf, respectively, assigned to the B sub-pixels of the pixel block according to values of lower 3 bits of the 9-bit B input data. The eight 6-bit B data Bf are written to the corresponding eight B sub-pixels for each frame. A third FRC operation for one B input data is performed to generate converted B data for eight frames. Accordingly, a total number of the converted B data generated from one B input data may be 64 to write the converted B data into the corresponding B sub-pixels for eight frames.

The FRC pattern of the converted B data Bf for eight frames generated by the third FRC operation may be determined according to values of lower 3 bits of the 9-bit B input data, and a third LUT may be used to perform the third FRC operation according to lower 3 bits of the 9-bit B input data. The values of lower 3-bits are (000), (001), (010), (011), (100), (101), (110) and (111), and the third FRC portion 56 performs the third FRC operation to generate different FRC patterns according to the values of the lower 3 bits.

In other words, in each frame, a number of the B sub-pixels of the pixel block having a gray level A represented by the upper 6 bits of the 9-bit B input data and a number of the B sub-pixels of the pixel block having a next higher gray level (A+1) may be determined according to the values of the lower 3 bits of the 9-bit B input data. Further, positions of the B sub-pixels of the pixel block having the gray level A and positions of the B sub-pixels of the pixel block having the next higher gray level (A+1) may be determined according to the values of the lower 3 bits of the 9-bit B input data. Accordingly, the B sub-pixels of the pixel block have the FRC pattern through the third FRC operation.

The first to third FRC portions 52, 54 and 56 are supplied with the 9-bit R, G and B data, respectively, and perform the first to third FRC operations independently from each other.

Accordingly, the FRC patterns of the 6-bit R, G and B data generated by the first to third FRC operations, respectively, are independent from one another and different.

Referring to FIG. 7, the converted R, G and B data through the first to third FRC portions (52, 54 and 56 of FIG. 6), respectively, are written to the corresponding R, G and B sub-pixels of the pixel block for $S^{th}$ to $(S+3)^{th}$ frames. In other words, data voltages corresponding to the converted R, G and B data are applied to the corresponding R, G and B sub-pixels. The R, G and B sub-pixels each alternately have a positive or negative polarity per frame according to an inversion operation. Hatched R, G and B sub-pixels each have a gray level A represented by upper 6 bits of each of 9-bit R, G and B input data, and non-hatched sub-pixel each have a next higher gray level (A+1).

The R, G and B input data are converted separately through the first to third FRC portions. For example, the first to third LUT may have different table values. Accordingly, the converted R, G and B data do not have the same FRC pattern. For example, in each pixel block, arrangement of the hatched R, G and B sub-pixels and the non-hatched R, G and B sub-pixels are not the same for each frame. Accordingly, the higher gray level R, G and B are distributed over the pixels of the pixel blocks, and thus the pattern such as the flowing line pattern and the lattice pattern or the flicker can be minimized. Accordingly, display quality can be improved.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a liquid crystal panel including a pixel block including pixels, the pixel including R, G and B sub-pixels;

a timing controller that converts an r-bit R external data into an n-bit R input data, converts an r-bit G external data into an n-bit G input data, and converts an r-bit B external data into an n-bit B input data if the r does not equal the n, wherein the timing controller converts the r-bit R, G and B external data into the respective R, G and B n-bit input data by adding a lowermost bit having a value zero to the respective r-bit R, G and B external data;

a first FRC portion that converts the n-bit R input data into (n−m)-bit R data having a first FRC pattern for consecutive P frames according to lower m bits of the n-bit R input data, wherein the (n−m)-bit R data for each of the consecutive P frames correspond to the R sub-pixels of the pixels of the pixel block, respectively;

a second FRC portion that converts the n-bit G input data into (n−m)-bit G data having a second FRC pattern for the consecutive P frames according to lower m bits of the n-bit G input data, wherein the (n−m)-bit G data for each of the consecutive P frames correspond to the G sub-pixels of the pixels of the pixel block, respectively; and a third FRC portion that converts the n-bit B input data into (n−m)-bit B data having a third FRC pattern for the consecutive P frames according to lower m bits of the n-bit B input data, wherein the (n−m)-bit B data for each of the consecutive P frames correspond to the B sub-pixels of the pixels of the pixel block, respectively, wherein the first, second and third FRC patterns are different and correspond to the R, G and B sub-pixels, respectively, and wherein the P,r,n and m are natural numbers, the r is less than or equal to the n, and the n is greater than the m.

2. The device of claim 1, wherein the P are $2^m$.

3. The device of claim 1, wherein the n is 9 and the m is 3.

4. The device of claim 1, wherein the pixel block includes the pixels in a K×l matrix, and wherein the K is greater than 1 and the L is greater than 1.

5. The device of claim 1, wherein each of the (n−m)-bit R, G and B data has one of a gray level represented by upper (n−m) bits of each of the n-bit R, G and B input data and a next higher gray level.

6. A method of driving a liquid crystal display device, comprising:

converting an r-bit R external data into an n-bit R input data, an r-bit G external data into an n-bit G input data, and an r-bit B external data into an n-bit B input data if the r does not equal the n, wherein converting the r-bit R, G and B external data into the respective R, G and B n-bit input data comprises adding a lowermost bit having a value zero to the respective r-bit R, G and B external data;

converting the n-bit R input data into (n−m)-bit R data having a first FRC pattern for consecutive P frames according to lower m bits of the n-bit R input data;

converting the n-bit G input data into (n−m)-bit G data having a second FRC pattern for the consecutive P frames according to lower m bits of the n-bit G input data;

converting the n-bit B input data into (n−m)-bit B data having a third FRC pattern for the consecutive P frames according to lower m bits of the n-bit B input data; and displaying images through a liquid crystal panel including a pixel block including pixels, the pixel including R, G and B sub-pixels, wherein the (n−m)-bit R data for each of the consecutive P frames correspond to the R sub-pixels of the pixels of the pixel block, respectively, wherein the (n−m)-bit G data for each of the consecutive P frames correspond to the G sub-pixels of the pixels of the pixel block, respectively, wherein the (n−m)-bit B data for each of the consecutive P frames correspond to the B sub-pixels of the pixels of the pixel block, respectively, wherein the first to third FRC pattern are different and correspond to the R, G and B sub-pixels, respectively, and wherein the P, r, n and m are natural number, the r is less than or equal to the n, and the n is greater than the m.

7. The method of claim 6, wherein the P are $2^m$.

8. The method of claim 6, wherein the n is 9 and the m is 3.

9. The method of claim 6, wherein the pixel block includes the pixels in a K×L matrix, and wherein the K is greater than 1 and the L is greater than 1.

10. The method of claim 6, wherein each of the (n−m)-bit R, G and B data has one of a gray level represented by upper (n−n) bits of each of the n-bit R, G and B input data and a next higher gray level.

* * * * *